US006338929B1

(12) United States Patent
Hagi et al.

(10) Patent No.: US 6,338,929 B1
(45) Date of Patent: Jan. 15, 2002

(54) TONER FOR DEVELOPING AN ELECTROSTATIC LATENT IMAGE

(75) Inventors: Masayuki Hagi, Minoo; Yoshihiro Mikuriya, Nishinomiya; Yoshitaka Sekiguchi, Nishinomiya; Kenichi Kido, Nishinomiya; Takeshi Arai, Akashi; Megumi Aoki, Itami; Tetsuo Sano, Amagasaki; Junichi Tamaoki, Sakai, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/669,571

(22) Filed: Sep. 26, 2000

(30) Foreign Application Priority Data

Sep. 29, 1999 (JP) ..... 11-276350

(51) Int. Cl.[7] ..... G03G 9/10

(52) U.S. Cl. ..... 430/108.4; 430/108.6; 430/111.4

(58) Field of Search ..... 430/106, 109, 430/110, 111, 108.4, 108.6, 111.4

(56) References Cited

U.S. PATENT DOCUMENTS 4,943,507 A 7/1990 Takahashi et al. ..... 430/120
5,248,581 A 9/1993 Nakayama et al. ..... 430/106.6
5,378,572 A 1/1995 Akiyama et al. ..... 430/110
5,776,646 A 7/1998 Hagi et al. ..... 430/106.6
5,891,600 A * 4/1999 Okuno et al. ..... 430/110

FOREIGN PATENT DOCUMENTS

JP 09-297427 11/1997

* cited by examiner

*Primary Examiner*—John Goodrow
(74) *Attorney, Agent, or Firm*—Burns, Doane, Swecker & Mathis, LLP

(57) ABSTRACT

The present invention provides a toner for developing an electrostatic latent image which suppresses an adhesion and wearability on a surface of a photosensitive member and exhibits an excellent rising property of an electrification. The toner comprises (i) toner particles containing a binder resin and a colorant, (ii) a first external additive consisting of first inorganic particles whose number-average particle size is 5–40 nm, (iii) a second external additive consisting of second inorganic particles whose number-average particle size, which is larger than that of the first external additive, is 20–160 nm, (iv) a third external additive consisting of third inorganic particles whose number-average particle size, which is larger than that of the second external additive, is 80–1200 nm, and (v) a fourth external additive consisting of a metal salt of fatty acid whose volume-average particle size is 1.5–12 $\mu$m, said four external additives being externally added to the toner particles.

20 Claims, No Drawings

TONER FOR DEVELOPING AN ELECTROSTATIC LATENT IMAGE

This application is based on an application No. 276350/1999 filed in Japan, the contents of which are hereby incorporated by reference.

BACKGROUND OF THE INVENTION

1. Field of the Invention

The present invention relates to a toner for developing an electrostatic latent image.

2. Description of the Prior Art

It has been well known that particulate inorganic compounds, such as silica, titania and the like are externally added to toner particles used for an electrophotography in order to afford the desirable flowability to said toner particles. In recent years when demands for a digitization and a high image quality in particular have been increased in the electrophotography, a smaller atomization is required of the toner particles. It is necessary to use a large amount of a fluidizing agent in order to afford the desirable flowability to the toner having small particle size. In the case of a full color toner where the aforesaid characteristics in general are most severely required, ultrafine inorganic particles whose average primary particle size is about 10–50 nm are externally added to almost all full color toners in an amount of not less than 1.0%.

However, in the case where a large amount of these ultrafine inorganic particles is externally added to the toner particles, there is a problem that the inorganic particles which are peeled off from the toner particles pass through a space between the photosensitive member and a cleaning blade in a cleaning process to adhere on the photosensitive member, and the adhered inorganic particles cause a black spot (BS) on the copied images. When the inorganic particles are adhered on the photosensitive member, the toner accumulates on the circumferences of the adhered inorganic particles, and BS appears as a noise in unimaged parts on the copied images.

In order to solve the problem, a technique has been proposed wherein inorganic particles having a relatively large particles size are externally added to the toner particles, and the deposit on the surface of photosensitive member is removed by an abrasive action (U.S. Pat. No. 5,776,646). However, although the technique makes it possible to suppress the occurrence of BS, it brings about a new problem that the surface of the photosensitive member is remarkably abraded and a life of the photosensitive member is shortened.

Furthermore, a technique has been proposed wherein particles of a metal salt of fatty acid are externally added to the toner particles from the viewpoint of a prevention against the adhesion on the surface of the photosensitive member (Japanese Patent Publication (KOKAI) No. 297427/1997). However, although the technique makes it possible to suppress the occurrence of BS, it brings about a new problem that a tendency to increase an electrification amount at the time of initial electrification of the toner is strengthened, and a fogging occurs on the initial copied imaged. In addition, although the potential characteristics are stable because the surface of the photosensitive member is abraded and refreshed at all times, there is a problem that the potential characteristics become unstable and a reproducibility of the image becomes worse when an addition of particulate metal salt of fatty acid brings about too small abraded amount of the surface of the photosensitive member.

Furthermore, as regards the toner in general, there are problems that a decrease of an image concentration and a fogging are occurred as the electrification amount of the toner is remarkably changed under various environments, particularly under the environment of low temperature and humidity (an environmental stability) and that even though the toner is subjected to the environment of middle temperature and humidity, the fogging is occurred on the copied image at the time of continuous copying (a durability).

SUMMARY OF THE INVENTION

The present invention has been made in consideration of the aforementioned circumstances. The object of the present invention is to provide a toner for developing an electrostatic latent image which suppresses the adhesion and wearability on the surface of the photosensitive member and exhibits the excellent rising property of the electrification. Another object of the present invention is to provide a toner for developing an electrostatic latent image which suppresses the adhesion and wearability on the surface of the photosensitive member and exhibits the excellent rising property of the electrification, environmental stability and durability.

The present inventors have found that these objects can be achieved by adding four external additives having specified particle sizes to toner particles containing a binder resin and a colorant.

The present invention relates to a toner which comprises (i) toner particles containing a binder resin and a colorant, (ii) a first external additive consisting of first inorganic particles whose number-average particle size is 5–40 nm, (iii) a second external additive consisting of second inorganic particles whose number-average particle size, which is larger than that of the first external additive, is 20–160 nm, (iv) a third external additive consisting of third inorganic particles whose number-average particle size, which is larger than that of the second external additive, is 80–1200 nm, and (v) the fourth external additive consisting of a metal salt of fatty acid whose volume-average particle size is 1.5–12 $\mu$m, said four external additives being externally added to the toner particles.

DETAILED DESCRIPTION OF THE INVENTION

The toner according to the present invention comprises publicly known toner particles and the particulate first, second, third and fourth external additives which are externally added to said toner particles. In the present specification, the wording of "externally add" means to add these additives to the preformed toner particles in such a way that said additives exist on the outer surfaces of said toner particles.

As the first external additive, the first inorganic particles are employed which have the number-average particle size of 5–40 nm, preferably 10–30 nm, more preferably 10–25 nm. It is preferable to use hydrophobic silica or titania particles as the inorganic particles. The hydrophobic silica is more preferable. By externally adding the first external additive to the toner particles, it is possible to afford the desired flowability to the toner. When the toner has not the desired flowability, the rising property of the electrification becomes worse, and a fineness of the copied images at the initial and last stages becomes coarse. When the number-average particle size is less than 5 nm, the flowability of the toner is remarkably decreased because the first external additive is embeded in the toner by an agitating stress of a developing agent. If the number-average particle size is more than 40 nm, the effect of affording the flowability to the toner is remarkably decreased.

The publicly known hydrophobic silica and titania can be employed as the first external additive provided that they have the aforementioned particle size and are hydrophobic. As the hydrophobic silica which is used as the first external additive, for example, TS500 (Cabosil Co.), R972, R974, R976 (Nihon Aerozil Co.), H2000, H2000/4M (Clarient Co.) and the like can suitably be used. As the hydrophobic titania which is used as the first external additive, STT30A (Titan Kogyo Co.), MT-150 (Teika Co.) and the like can suitably be used. Furthermore, the silica and titania having the desired particle size may be employed which are hydrophobicized with hydrophobicizing agent. The publicly known silane coupling agent, silicone oil and the like can be used as the hydrophobicizing agent.

The desirable hydrophobicizing degree of the first external additive is not less than 50%, preferably 60–70%. When the hydrophobicizing degree is less than 50%, it is difficult to put said additive to practical use because the flowability and electrification amount of the toner are remarkably changed by a small environmental change.

An adding amount of the first external additive is 0.05–2.00% by weight, preferably 0.08–1.20% by weight, more preferably 0.1–1.0% by weight relative to the weight of the toner particles. When the adding amount of the first external additive is less than 0.05% by weight, a sufficient flowability cannot be given to the toner. On the other hand, if the adding amount of the first external additive is more than 2.00% by weight, an amount of the exfoliated first external additive from the toner is increased and the problems that a carrier is contaminated and the fogging, dust smoke and the like occur at the last stage of durability are brought about when the toner is used as the two-component developing agent.

As the second external additive, the second inorganic particles are employed which have the number-average particle size of 20–160 nm, preferably 30–100 nm, more preferably 30–80 nm, said number-average particle size being larger than that of the first external additive. It is preferable to use hydrophobic silica and titania. The hydrophobic titania is more preferable. By externally adding the second external additive to the toner particles, it is possible to easily afford the desired flowability to the toner. When the number-average particle size is less than 20 nm, the flowability of the toner is remarkably decreased because the second external additive is embeded in the toner by the agitating stress of the developing agent. If the number-average particle size is more than 160 nm, the effect of affording the flowability to the toner is remarkably decreased.

The publicly known hydrophobic silica and titania can be employed as the second external additive provided that they have the aforementioned particle size and are hydrophobic. For example, as the hydrophobic titania which is used as the second external additive, the commercially available titanium oxide particles may be employed after they are subjected to the hydrophobicizing treatment. For example, the following commercially available products can suitably be used after they are subjected to the hydrophobicizing treatment with the publicly known silane coupling agent, silicone oil and the like as the hydrophobicizing agent: the products of STT series supplied by Titan Kogyo Co., the products of TTO series supplied by Ishihara Sangyo Co., the products of MT series supplied by Teika Co. and the like. As the hydrophobic silica which is used as the second external additive, for example, RX50, #70, #90 and the like can suitably be employed after they are subjected to the hydrophobicizing treatment with the silane coupling agent. Furthermore, the silica having the desired particle size may be employed which are hydrophobicized with the publicly known silane coupling agent, silicone oil and the like.

The desirable hydrophobicizing degree of the second external additive is not less than 40%, preferably 50–70%. When the hydrophobicizing degree is less than 40%, it is difficult to put said additive to practical use because the flowability and electrification amount of the toner are remarkably changed by a small environmental change.

An adding amount of the second external additive is 0.05–2.00% by weight, preferably 0.08–1.20% by weight, more preferably 0.1–1.0% by weight relative to the weight of the toner particles. When the adding amount is less than 0.05% by weight, a sufficient flowability cannot be given to the toner. On the other hand, if the adding amount is more than 2.00% by weight, an amount of the exfoliated second external additive from the toner is increased and the carrier is contaminated when the toner is used as the two-component developing agent.

The environmental stability and durability of the toner can also be increased by the embodiment of the present invention wherein (i) the number-average particle size of the first external additive is 10–30 nm, preferably 10–25 nm, (ii) the adding amount of the first external additive is 0.08–1.20% by weight, preferably 0.1–1.0% by weight relative to the weight of the toner particles, (iii) the number-average particle size of the second external additive is 30–100 nm, preferably 30–80 nm, and (iv) the adding amount of the second external additive is 0.08–1.20% by weight, preferably 0.1–1.0% by weight relative to the weight of the toner particles. In other words, the aforementioned embodiment brings about not only the suppression of the adhesion and wearability on the surface of the photosensitive member and the increase of the rising property of the electrification but also the increase of the environmental stability and durability. When the environmental stability is increased, the electrification amount of the toner does not change too much, and the decrease of the image concentration and the occurrence of the fogging can be avoided even if the copying is carried out under the various environments, particularly under the environment of low temperature and humidity. When the durability is increased, the fogging is hard to occur on the copied image even if the copying is carried out successively.

As the third external additive, the third inorganic particles are employed which have the number-average particle size of 80–1200 nm, preferably 80–1000 nm, more preferably 100–800 nm, said number-average particle size being larger than that of the second external additive. It is preferable to use the third external additive which contains not more than 20% by number, more preferably not more than 10% by number of the particles whose particle size is not less than 1500 nm. By externally adding the third external additive to the toner particles, a stationary layer formed of the third external additive is formed in the space between the photosensitive member and the cleaning blade. The stationary layer prevents the passages of other particulate ingredients through said space to suppress BS on the copied image caused by the adhesion of the first and second external additives in particular. Furthermore, the third external additive functions as a spacer between the toner particles to increase a transferability of the toner. In addition, by using the third external additive in combination with the aftermentioned fourth external additive, a suitable abrasion of the photosensitive member is possible, and an increase of the electrification amount at the initial stage of electrification of the toner can be suppressed, said increase of the electrification amount coming into problem in the case where the fourth external additive is employed without using the third external additive.

When the number-average particle size of the third external additive is less than 80 nm, said additive is hard to collect in the space between the cleaning blade and the photosensitive member and is easy to pass through said space, and the stationary layer is hard to build up satisfactorily. The embodiment wherein the number-average particle size of the third external additive is more than 1200 nm is unpreferable because the surface of the photosensitive member cannot uniformly be abraded by said additive. Furthermore, the embodiment wherein the particulate third external additive which contains more than 20% by number of the particles whose particles size is not less than 1500 nm is employed is unpreferable because the particles are collected in the cleaning blade and are apt to injure the surface of the photosensitive member.

Although the third external additive is not particularly restricted provided that it is an inorganic material having the aforementioned particles size, it is preferable to employ the inorganic material which has such a hardness as to abrade the surface of the photosensitive member. For example, it is preferable to employ silica, titania, alumina, titanate, silicate, sintered products of these inorganic materials and the like. Furthermore, it is preferable to use the third external additive which has a weak positive electrifying property. When the third external additive having the weak positive electrifying property is used, the additive gives the toner of the present invention a negative electrifying property, and its function as the spacer between the toner and the carrier is increased and a carrier deterioration caused by a transfer of the additive to the carrier is suppressed to obtain an excellent rising property of electrification in the case where the toner is employed as two-component developing agent. It is more suitable to use strontium titanate particles as the particles having the suitable hardness and weak positive electrification property. The third external additive may be used after it is hydrophobicized with the publicly known silane coupling agent, silicone oil and the like.

An adding amount of the third external additive is 0.4–3.5% by weight, preferably 0.5–3.0% by weight, more preferably 1.0–3.0% by weight relative to the weight of the toner particles. When the adding amount is less than 0.4% by weight, the formation of the stationary layer in the cleaning blade cannot be secured. If the adding amount is more than 3.5% by weight, the abrasion of the toner becomes too severe to decrease a lifetime of the photosensitive member.

Particulate metal salts of fatty acids whose volume-average particle size is 1.5–12 $\mu$m, preferably 2–10 $\mu$m are employed as the fourth external additive. By externally adding the fourth external additive to the toner, a lubricative film is uniformly formed on the surface of the photosensitive member to prevent the adhesion on said surface, and the occurrence of BS can be prevented (a lubricating function). Furthermore, by using the fourth external additive in combination with the third external additive, a suitable abrasion of the photosensitive member becomes possible because an excess abrading action of the third external additive on the surface of the photosensitive member can be suppressed, said excess abrading action coming into problem in the case where the third external additive is employed without using the fourth external additive.

When the volume-average particle size of the fourth external additive is less than 1.5 $\mu$m, the fourth external additive is transferred onto a paper together with the toner, and an amount of the fourth external additive that functions on the photosensitive member is remarkably decreased. If the volume-average particle size of the particulate fourth external additive is more than 12 $\mu$m, numbers of the particles are decreased to reduce the lubricating effect of said additive.

The metal salts of fatty acids which are used as the fourth external additive are not particularly restricted provided that they have the aforesaid particle size. For example, the metal salts of the fatty acids represented by the following general formula can be mentioned:

$C_nH_{2n+1}COOH$ (wherein n is an integer of 12–18)

The metals are not particularly restricted provided that they can form a salt with the aforesaid fatty acids. For example, calcium, zinc, magnesium, aluminum, lithium and the like can be mentioned. From the viewpoints of a cost, a safety and a reduction in elasticity (hardness) of silicone rubber in a full color process, calcium is a suitable metal.

From the viewpoints of the heat resistance and lubricity, the metal salts of fatty acids whose melting points are about 100–150° C. are favorable. For example, it is preferable to use calcium stearate, zinc stearate, magnesium stearate and the like. When the melting points of the metal salts of fatty acids is less than 100° C., the heat resistance of the toner becomes worse, and the toner coheres during a storage under the environment of high temperature. If the melting points are more than 150° C., the lubricating function is reduced. Although a calcium stearate prepared by a direct method and that prepared by a double-decomposition method are known, it is preferable to use the calcium stearate which contains a small amount of impurities prepared by the direct method after said stearate is pulverized and then subjected to an adjusting treatment of particle size.

An adding amount of the fourth external additive is 0.02–0.25% by weight, preferably 0.02–0.2% by weight, more preferably 0.02–0.1% by weight relative to the weight of the toner particles. When the adding amount of the fourth external additive is less than 0.02% by weight, the lubricating function of said additive cannot be secured. If the adding amount is more than 0.25% by weight, the rising property of electrification becomes remarkably worse, and noises, such as the fogging and the like occur.

The toner particles to which the aforementioned first, second, third and fourth external additives are externally added contain at least of a binding resin and a colorant. The toner particles comprises a release agent, a charge-controlling agent and the like as the occasion may demand.

The publicly known binder resins in the field of the electrophotography may be employed as the binder resin in the present invention. For example, the following resins are suitably employed: styrene resins, acrylic resins (e.g., alkyl acrylate resin, alkyl methacrylate resin and the like), styrene-acrylate copolymerization resins, polyester resins, silicone resins, olefin resins, amido resins, epoxy resins and the like.

In order to increase a light permeability of OHP and a color reproducibility of the superposed image, it is preferable to use the binding resin having high transparency, low melting viscosity and high sharp melt property for a full color toner which comprises many external additives and is apt to bring about the problem of BS. Polyester resins are suitable for the binding resin having these properties.

With respect to the binder resin used for full color toners such as cyan toner, magenta toner and yellow toner in the present invention, those resins having the following properties are preferably used from the viewpoints of a fixing property at the time of bending a full-color solid image, a fixing strength, a high temperature offset, a sharp melting property, a light-transmitting property of the toner, a color-mixing property at the time of a full-color image-formation, a heat resistant property of the toner, a fixing property and a glass property of a full color image: a number-average molecular weight (Mn) of 3000 to 6000, preferably 3500 to 5500, a ratio Mw/Mn of weight-average molecular weight (Mw) to number-average molecular weight (Mn) of 2 to 6, preferably 2.5 to 5.5, a glass transition point of 50 to 70° C., preferably 55 to 70° C., and a softening point of 90 to 110° C., preferably 90 to 105° C.

The glass transition point (Tg) of the binding resin is the value measured by the following method:

Differential thermal analysis of the resin was carried out by means of the aforesaid differential scanning calorimeter under the following conditions.

Reference: alumina

Sample: 10 mg

Rate of temperature increase: 10° C./min

Heating range: 20–120° C.

A shoulder value of the main endothermic peak was regarded as the glass transition point.

The softening point (Tm) of the binding resin is the value measured by the following method:

A starting point and a finishing point of a flow of the melted sample from a fine pore of a dice was measured by means of a flow tester under the following conditions.

Size of the fine pore: 1 mm (diameter)×1 mm (length)

Sample: 1 $cm^2$

Pressure: 20 $kg/cm^2$

Rate of temperature increase: 6° C./min

A temperature which corresponds to half of the height of from the starting point to the finishing point was regarded as the softening point.

The publicly known pigments and dyes may be adopted as a colorant. Examples thereof include carbon black, aniline blue, Chalco Oil Blue, chrome yellow, ultramarine blue, DuPont Oil Red, quinoline yellow, methylene blue chloride, copper phthalocyanine, Malachite green oxalate, Lump Black, Rose Bengal. As a colorant for the magenta toner, C.I. Pigment Red 48:1, C.I. Pigment Red 122, C.I. Pigment Red 57:1 and C.I. Pigment Red 184 may be employed. As a colorant for yellow toner, C.I. Pigment Yellow 97, C.I. Pigment Yellow 12, C.I. Pigment Yellow 180, C.I. Pigment Yellow 17, C.I. Pigment Yellow 93 and C.I. Solvent Yellow 162 may be employed. As the colorant for the cyan toner, C.I. Pigment Blue 15:1 and C.I. Pigment Blue 15:3 may be employed. When the toner of the present invention is used as a magnetic toner, some or all amount of the colorant may be replaced by a magnetic material. Examples of such a magnetic material include magnetite, ferrite, iron power, nickel powder, etc.

In order to increase the anti-offset property etc., the toner of the present invention may contain a releasant. Examples of such a releasant include polyethylene wax, polypropylene wax, carnauba wax, rice wax, sazol wax, montan ester waxes, Fischer-Tropsch wax, etc. In the case of addition of a wax to the toner, the content is preferably in the range of 0.5 to 5 parts by weight relative to 100 parts by weight of the binder resin. Thereby, it becomes possible to obtain the effects of the addition without causing disadvantages, such as filming, etc.

From the viewpoint of improvement in the anti-offset property, polypropylene wax is preferably contained. From the viewpoint of improvements in smear-preventive properties ("smear" means a phenomenon in which, when a paper-sheet with images copied on its one side is fed by an automatic document-feeding apparatus or in a double-sided copying machine, degradation in the copied image, such as blurring and stains, occurs due to friction between the sheets or between the sheet and rollers on the image), polyethylene wax is preferably contained. From the above-mentioned viewpoints, the polypropylene wax is preferably set to have a melt viscosity of 50 to 300 cps at 160° C., a softening point of 130 to 160° C. and an acid value of 1 to 20 KOH mg/g. The polyethylene wax is more preferably set to have a melt viscosity of 1,000 to 8,000 cps at 160° C. and a softening point of 130 to 150° C. The polypropylene wax having the above-mentioned melt viscosity, softening point and acid value exhibits a superior dispersing properties to the binder resin. The anti-offset properties are improved without causing problems due to isolated wax. In addition, the polyethylene wax having the above-mentioned melt viscosity, softening point and acid value also exhibits a superior dispersing properties to the binder resin. The polyethylene wax can increase the smear-preventive properties by decreasing a friction coefficient of the fixed image surface without causing problem due to isolated wax. Further, the melt viscosities of the waxes were measured by means of Brookfield type viscometer.

As a charge-control agent for a positive charge-toner, the following positive charge-control agents are exemplified: Nigrosine Base EX. of azine compounds, Bontron N-01, Bontron N-02, Bontron N-04, Bontron N-05, Bontron N-07, Bontron N-09, Bontron N-10, Bontron N-13 (Orient Kagaku Kogyo Co.); Oil Black (Chuou Gosei Kagaku Co.); quaternary ammonium salt P-51, polyamine compound P-52, Sudan Chief Schwartz BB (Solvent Black 3: C.I. No. 26150), Fett Schwartz HBN (C.I. No. 26150), Brilliant Spirit Schwartz TN (Farbenfabriken Bayer Co.); alkoxylated amine, alkyl amide, molybdenum acid chelate pigments, imidazole compounds and the like.

As a charge-control agent for a negative charge-toner, the following negative charge-control agents are exemplified: chrome complex type azo dyes S-32, S-33, S-34, S-35, S-37, S-38, S-40 (Orient Kagaku Kogyo Co.); Aizen Spilon Black TRH, Aizen Spilon Black BHH (Hodogaya Kagaku Co.); Kayaset Black T-22, Kayaset Black 004 (Nihon Kagaku Co.); Copper phthalocyanine dye S-39 (Orient Kagaku Kogyo Co.); chrome complexes of salicylic acid E-81, E-82 (Orient Kagaku Kogyo Co.); zinc complex E-84 (Orient Kagaku Kogyo Co.); aluminum complex E-86 (Orient Kagaku Kogyo Co.); calix arene compounds and the like.

With respect to the negative charge-control agent used for full color toners, colorless, white or light-colored charge-control agents, which do not give adverse effects on the tone and the light-transmitting properties of the color toner, may be applied. Examples thereof include metal complexes of zinc and chromium of salicylic acid derivatives, calix arene compounds, organic boron compounds, quaternary ammonium salt compounds containing fluoride, etc. With respect to the metal complex of salicylic acid derivative, for example, those disclosed in U.S. Pat. No. 4,206,064, U.S. Pat. No. 4,762,763 etc. may be adopted. With respect to calix arene compounds, for example, those disclosed in U.S. Pat. No. 5,049,467, etc. may be adopted. With respect to organic boron compounds, for example, those disclosed in U.S. Pat. No. 5,863,692, etc. may be adopted. With respect to quaternary ammonium salt compounds containing fluoride, for example, those disclosed in U.S. Pat. No. 5,069,994, etc. may be adopted.

With respect to a process for preparing the toner particles of the present invention, any of the publicly known preparation methods can be employed. For example, dry processes, such as grinding method and the like, and wet processes, such as an emulsion polymerization method, a suspension polymerization, an emulsion granulation method and the like can be mentioned. Generally speaking, the grinding method provides the particles having an indefinite shape, and the wet processes provide spherical particles. The preparation methods of the toner which is suitable for an image formation process may be employed. From the viewpoint of an image quality, toner particles having a small particle size is preferably employed, and the toners having volume-average particle sizes of about 4–10 μm can suitably be used. In particular, it is preferable in the present invention to employ the toner particles having volume-average particle sizes of 6–8 μm.

At the time of externally adding the aforesaid first, second, third and fourth external additives to the aforementioned toner particles, the publicly known process for externally adding an additive can be employed provided that these ingredients of the toner can uniformly be mixed. For example, the aforesaid four external additives which are specified in the present invention are added in a lump to the toner particles, and these ingredients of the toner may be mixed by means of Henschel mixer and the like. Furthermore, although each of the four external additives may separately be added to the toner particles, it is preferable to finally add silica, particularly the hydrophobic silica which is used as the first external additive, to the toner particles and then to mix them in order to more increase the rising property of electrification.

The toner according to the present invention can be employed in one-component developing agent containing no carrier or two-component developing agent containing a carrier. The toner of the present invention may be magnetic or unmagnetic.

As the carrier which is used together with the toner of the present invention, the publicly known carriers can be used. For example, (i) the carrier containing of magnetic particles, such as iron powder, ferrite powder and the like, (ii) coat-type carriers wherein the surface of magnetic particles is coated with coating agents, such as a resin and the like or (iii) binder-type carriers wherein the magnetic particles are dispersed in the binder resin, and the like can be employed. Suitable carriers are those having the volume-average particle size of 20–60 μm, preferably 30–50 μm.

The present invention will concretely be illustrated by the examples hereinafter.

EXAMPLES

External Additives

As the first external additive, the silica particles having the number-average particle size of 5 nm, 15 nm, 30 nm or 40 nm were employed, said silica particles being hydrophobicized with hexamethyldisilazane (HMDS). The hydrophobicizing degrees of these silica particles whose number-average particle size is 5 nm, 15 nm, 30 nm and 40 nm were 55%, 60%, 60% and 60% respectively.

As the second external additive, the titania particles having the number-average particle size of 20 nm, 30 nm, 50 nm, 100 nm or 150 nm were employed, said titania particles being hydrophobicized with isobutyltrimethoxysilane. The hydrophobicizing degrees of these titania particles whose number-average particle size is 20 nm, 30 nm, 50 nm, 100 nm and 150 nm were 50%, 55%, 55%, 60% and 60% respectively.

As the third external additive, the titania particles having the number-average particle size of 50 nm, 70 nm, 100 nm, 200 nm, 1000 nm or 1500 nm as well as the strontium titanate having the number-average particle size of 300 nm were employed. The contents of the particles having the number-average particle size of not less than 1500 nm contained in these third external additives whose number-average particle size is 50 nm, 70 nm, 100 nm, 200 nm, 1000 nm, 1500 nm and 300 nm are 0% by number, 0% by number, 3% by number, 10% by number, 30% by number and 5% by number respectively.

As the fourth external additive, the calcium stearate particles having the volume-average particle size of 1 μm, 2 μm, 5 μm, 10 μm or 15 μm were employed.

Preparations of the toners of the Examples 1–13 and the Comparative Examples 1–24

According to the blending ratios shown in Tables 1 and 2, the first, second, third and fourth external additives were added to the aforesaid toner particles and mixed by means of Henschel mixer, and the mixtures were passed through a vibrating sieve to obtain the toners. The adding amounts (% by weight) of the external additives shown in Tables 1 and 2 are those relative to the weight of the toner particles.

Preparation of the Two-component Developing Agents

Each of the toners prepared in the aforesaid examples and comparative examples was mixed with the aftermentioned carrier 1 under stirring in such a way that a concentration of the toner in the developing agent becomes 6% by weight, and the two-component developing agents were obtained.

Evaluations of the Developing Agents

The developing agents prepared in the examples and comparative examples were evaluated according to the following evaluation items.

(1) BS

The developing agent was charged in a full color copying machine CF900 (Minolta Co., Ltd.), and a manuscript having an image region of 15% was successively copied 30000 times by means of said copying machine. A black spot (BS) on the image was evaluated by a visual observation. The rankings of the evaluation are as follows:

"○": No BS occurred.

"Δ": A few BS occurred.

"x": Many BS occurred.

(2) The Rising Property of Electrification Behavior

The toner was charged in a polyethylene bottle (50 cc) in such a way that the TC ratio becomes 6%, and electrification amount of the toner was measured by means of E-SPART analyzer (Hosokawa Micron Corp.) after said toner is stirred with a roll mill for 5 minutes, 100 minutes and 600 minutes. The percentage A (%) of the electrification amount after the stirring for 5 minutes relative to that after the stirring for 100 minutes, and the percentage B (%) of the electrification amount after the stirring for 100 minutes relative to that after the stirring for 600 minutes were determined. The rankings of the evaluation are as follows:

"◎": $A \geqq 100\%$; $B \geqq 100\%$

"○": $80 \leqq A < 100\%$; $B \geqq 100\%$

"Δ": $80 \leqq A < 100\%$; $80 \leqq B < 100\%$

"x": $A < 80\%$; $B < 80\%$

In the cases of "x" and "Δ", the cause thereof, i.e., low electrification amount ("low") or high electrification amount ("high") was shown in addition.

(3) The Abrasion of the Photosensitive Member

The developing agent was charged in the full color copying machine CF900 (Minolta Co., Ltd.), and a manuscript (a ratio of the image region to the unimaged region: 15%) was successively copied 30000 times by means of said copying machine. The film thickness of the photosensitive into layer was measured by means of an eddy-current type apparatus for measuring a film thickness (Permascope EC type; Fischer Co.), and an abrasion loss of the photosensitive member per 100000 revolutions of said member was calculated. When the abrasion loss is larger than 4 μm, a durability of the photosensitive member cannot be secured because of excessive abrasion. If the abrasion loss is smaller than 2 μm, a performance of the photosensitive member cannot be maintained because of too small abrasion loss. In addition, an examination for the presence of scratches on the surface of the photosensitive member was made by a visual observation after the successive copying. The rankings of the evaluation are as follows:

"○": The abrasion loss was 2–4 μm, and no scratch was occurred.

"x" The abrasion loss was less than 2 μm or more than 4 μm, or the scratches were occurred.

In the case of "x", the cause thereof (small abrasion, large abrasion or scratch) was shown in addition.

(4) The initial image quality (texture)

The developing agent was charged in the full color copying machine CF900 (Minolta Co., Ltd.) and a manuscript (a ratio of the image region to the unimaged region: 15%) was copied by means of said copying machine. The texture on the initial image was evaluated by a visual observation. It is thinkable that the texture becomes fine when the fluidity is sufficient, and the texture becomes coarse if the fluidity is insufficient. The rankings of the evaluation are as follows:

"○": The texture was fine, and the image was sufficiently clear.

"x": There was a practical problem since the texture was coarse, and the image was rough.

(5) The Environmental Stability

The developing agent was charged in the full color copying machine CF900 (Minolta Co., Ltd.), and a manuscript having an image region of 15% was successively copied 1000 times by means of said copying machine under the environmental conditions of 15° C./20% (L/L) or 35° C./80% (H/H). The image concentration and the fogging on the image were evaluated by a visual observation. It is thinkable that the image concentration is decreased when the electrification amount of the toner becomes too high, and the fogging occurs if the electrification amount of the toner becomes too low. The rankings of the evaluation are as follows:

"○": The decrease of the image concentration and the fogging did not occur.

"Δ": Although the decrease of the image concentration and/or the fogging occurred to some extent, there was no practical problem.

"x": The decrease of the image concentration and/or the fogging occurred.

In the cases of "Δ" and "x", the environmental condition (LL or HH) which came into question and the change of the electrification amount (increase or decrease) which seemed as their causes were shown in addition.

(6) Fogging

The developing agent was charged in the full color copying machine CF900 (Minolta Co., Ltd.), and a manuscript having an image region of 15% was successively copied 30000 times. The fogging on the image was evaluated by a visual observation. The rankings of the evaluation are as follows:

"○": The fogging did not occur.

"Δ": The fogging occurred to some extent.

"x": Many foggings occurred.

The obtained results of the aforementioned evaluations are summarized in Tables 3 and 4.

In the present specification, the particle sizes calculated on the basis of the photographs of TEM observation are used as the number-average particle sizes of the first, second and third external additives. The particles sizes measured by means of a light scattering-type equipment for measuring a particle size distribution are used as the volume-average particle size of the fourth external additive.

According to the present invention, the excellent effects can be obtained that the adhesion and wearability on the surface of the photosensitive member are suppressed, and the rising property of the electrification is increased. Furthermore, the present invention provides an excellent effect that the environmental stability and durability can be increased by controlling the number-average particle sizes and adding amounts of the first and second external additives.

TABLE 1

| | 1st external additive | | | 2nd external additive | | | 3rd external additive | | | 4th external additive | | |
|---|---|---|---|---|---|---|---|---|---|---|---|---|
| | Kind(1) | Particle size (nm) | Amount (wt %) | Kind(2) | Particle size (nm) | Amount (wt %) | Kind(3) | Particle size (nm) | Amount (wt %) | Kind(4) | Particle size (μm) | Amount (wt %) |
| Ex. 1 | $SiO_2$ | 5 | 1 | $TiO_2$ (h) | 50 | 0.5 | $TiO_2$ | 200 | 1.5 | Ca-Ste | 5 | 0.1 |
| Ex. 2 | $SiO_2$ | 30 | 0.1 | $TiO_2$ (h) | 50 | 0.5 | $TiO_2$ | 200 | 1.5 | Ca-Ste | 5 | 0.1 |
| Ex. 3 | $SiO_2$ | 15 | 0.5 | $TiO_2$ (h) | 30 | 1 | $TiO_2$ | 200 | 1.5 | Ca-Ste | 5 | 0.1 |
| Ex. 4 | $SiO_2$ | 15 | 0.5 | $TiO_2$ (h) | 100 | 0.1 | $TiO_2$ | 200 | 1.5 | Ca-Ste | 5 | 0.1 |
| Ex. 5 | $SiO_2$ | 15 | 0.5 | $TiO_2$ (h) | 50 | 0.5 | $TiO_2$ | 100 | 3 | Ca-Ste | 5 | 0.1 |
| Ex. 6 | $SiO_2$ | 15 | 0.5 | $TiO_2$ (h) | 50 | 0.5 | $TiO_2$ | 1000 | 0.5 | Ca-Ste | 5 | 0.1 |
| Ex. 7 | $SiO_2$ | 15 | 0.5 | $TiO_2$ (h) | 50 | 0.5 | $TiO_2$ | 200 | 1.5 | Ca-Ste | 2 | 0.02 |
| Ex. 8 | $SiO_2$ | 15 | 0.5 | $TiO_2$ (h) | 50 | 0.5 | $TiO_2$ | 200 | 1.5 | Ca-Ste | 10 | 0.2 |
| Ex. 9 | $SiO_2$ | 15 | 0.5 | $TiO_2$ (h) | 50 | 0.5 | Sr-Tit | 300 | 1.5 | Ca-Ste | 5 | 0.1 |
| Ex. 10 | $SiO_2$ | 15 | 1.0 | $TiO_2$ (h) | 50 | 1.0 | Sr-Tit | 300 | 3.0 | Ca-Ste | 5 | 0.2 |
| Com. ex. 1 | $SiO_2$ | 5 | 1 | $TiO_2$ (h) | 50 | 0.5 | | — | | | — | |
| Com. ex. 2 | $SiO_2$ | 30 | 0.1 | $TiO_2$ (h) | 50 | 0.5 | | — | | | — | |

TABLE 1-continued

| | 1st external additive | | | 2nd external additive | | | 3rd external additive | | | 4th external additive | | |
|---|---|---|---|---|---|---|---|---|---|---|---|---|
| | Kind[1] | Particle size (nm) | Amount (wt %) | Kind[2] | Particle size (nm) | Amount (wt %) | Kind[3] | Particle size (nm) | Amount (wt %) | Kind[4] | Particle size (μm) | Amount (wt %) |
| Com. ex. 3 | $SiO_2$ | 15 | 0.5 | $TiO_2$ (h) | 30 | 1 | | — | | | — | |
| Com. ex. 4 | $SiO_2$ | 15 | 0.5 | $TiO_2$ (h) | 100 | 0.1 | | — | | | — | |
| Com. ex. 5 | $SiO_2$ | 15 | 0.5 | $TiO_2$ (h) | 50 | 0.5 | $TiO_2$ | 100 | 3 | — | | |
| Com. ex. 6 | $SiO_2$ | 15 | 0.5 | $TiO_2$ (h) | 50 | 0.5 | $TiO_2$ | 1000 | 0.5 | — | | |
| Com. ex. 7 | $SiO_2$ | 15 | 0.5 | $TiO_2$ (h) | 50 | 0.5 | Sr-Tit | 300 | 1.5 | — | | |
| Com. ex. 8 | | — | | $TiO_2$ (h) | 50 | 0.5 | $TiO_2$ | 200 | 1.5 | Ca-Ste | 5 | 0.1 |
| Com. ex. 9 | | — | | $TiO_2$ (h) | 30 | 1 | $TiO_2$ | 200 | 1.5 | Ca-Ste | 5 | 0.1 |
| Com. ex. 10 | | — | | $TiO_2$ (h) | 100 | 0.1 | $TiO_2$ | 200 | 1.5 | Ca-Ste | 5 | 0.1 |
| Com. ex. 11 | $SiO_2$ | 15 | 0.5 | $TiO_2$ (h) | 50 | 0.5 | | — | | Ca-Ste | 5 | 0.1 |
| Com. ex. 12 | $SiO_2$ | 15 | 0.5 | $TiO_2$ (h) | 50 | 0.5 | | — | | Ca-Ste | 2 | 0.02 |
| Com. ex. 13 | $SiO_2$ | 15 | 0.5 | $TiO_2$ (h) | 50 | 0.5 | | — | | Ca-Ste | 10 | 0.2 |

(1)"$SiO_2$" indicates a hydrophobic silica;
(2)"$TiO_2$ (h)" indicates a hydrophobic titania;
(3)"Sr-Tit" indicates strontium titanate;
(4)"Ca-Ste" indicates calcium stearate.

TABLE 2

| | 1st external additive | | | 2nd external additive | | | 3rd external additive | | | 4th external additive | | |
|---|---|---|---|---|---|---|---|---|---|---|---|---|
| | Kind[1] | Particle size (nm) | Amount (wt %) | Kind[2] | Particle size (nm) | Amount (wt %) | Kind[3] | Particle size (nm) | Amount (wt %) | Kind[4] | Particle size (μm) | Amount (wt %) |
| Ex. 11 | $SiO_2$ | 5 | 1.5 | $TiO_2$ (h) | 50 | 0.5 | $TiO_2$ | 200 | 1.5 | Ca-Ste | 5 | 0.1 |
| Ex. 12 | $SiO_2$ | 15 | 0.5 | $TiO_2$ (h) | 20 | 1.5 | $TiO_2$ | 200 | 1.5 | Ca-Ste | 5 | 0.1 |
| Ex. 13 | $SiO_2$ | 15 | 0.5 | $TiO_2$ (h) | 150 | 0.05 | $TiO_2$ | 200 | 1.5 | Ca-Ste | 5 | 0.1 |
| Com. ex. 14 | $SiO_2$ | 15 | 0.5 | $TiO_2$ (h) | 50 | 0.5 | $TiO_2$ | 50 | 4 | Ca-Ste | 5 | 0.1 |
| Com. ex. 15 | $SiO_2$ | 15 | 0.5 | $TiO_2$ (h) | 50 | 0.5 | $TiO_2$ | 1500 | 0.3 | Ca-Ste | 5 | 0.1 |
| Com. ex. 16 | $SiO_2$ | 15 | 0.5 | $TiO_2$ (h) | 50 | 0.5 | $TiO_2$ | 200 | 1.5 | Ca-Ste | 1 | 0.01 |
| Ex. 14 | $SiO_2$ | 40 | 1.5 | $TiO_2$ (h) | 50 | 0.5 | $TiO_2$ | 200 | 1.5 | Ca-Ste | 5 | 0.1 |
| Ex. 15 | $SiO_2$ | 15 | 0.5 | $TiO_2$ (h) | 20 | 0.05 | $TiO_2$ | 200 | 1.5 | Ca-Ste | 5 | 0.1 |
| Ex. 16 | $SiO_2$ | 15 | 0.5 | $TiO_2$ (h) | 150 | 1.5 | $TiO_2$ | 200 | 1.5 | Ca-Ste | 5 | 0.1 |
| Com. ex. 17 | $SiO_2$ | 15 | 0.5 | $TiO_2$ (h) | 50 | 0.5 | $TiO_2$ | 50 | 0.3 | Ca-Ste | 5 | 0.2 |
| Com. ex. 18 | $SiO_2$ | 15 | 0.5 | $TiO_2$ (h) | 50 | 0.5 | $TiO_2$ | 1500 | 4 | Ca-Ste | 5 | 0.1 |
| Com. ex. 19 | $SiO_2$ | 15 | 0.5 | $TiO_2$ (h) | 50 | 0.5 | $TiO_2$ | 200 | 1.5 | Ca-Ste | 1 | 0.3 |
| Com. ex. 20 | $SiO_2$ | 15 | 0.5 | $TiO_2$ (h) | 50 | 0.5 | $TiO_2$ | 200 | 1.5 | Ca-Ste | 15 | 0.01 |
| Com. ex. 21 | $SiO_2$ | 15 | 0.5 | | — | | Sr-Tit | 300 | 1.5 | Ca-Ste | 5 | 0.1 |
| Com. ex. 22 | $SiO_2$ | 15 | 0.5 | $TiO_2$ (h) | 50 | 0.5 | $TiO_2$ | 70 | 1.5 | Ca-Ste | 5 | 0.1 |
| Com. ex. 23 | $SiO_2$ | 15 | 0.5 | $TiO_2$ (h) | 50 | 0.5 | $TiO_2$ | 1500 | 1.5 | Ca-Ste | 5 | 0.1 |
| Com. ex. 24 | $SiO_2$ | 15 | 0.5 | $TiO_2$ (h) | 50 | 0.5 | $TiO_2$ | 200 | 1.5 | Ca-Ste | 1 | 0.1 |
| Com. ex. 25 | $SiO_2$ | 15 | 0.5 | $TiO_2$ (h) | 50 | 0.5 | $TiO_2$ | 200 | 1.5 | Ca-Ste | 15 | 0.1 |

(1)"$SiO_2$" indicates a hydrophobic silica;
(2)"$TiO_2$ (h)" indicates a hydrophobic titania;
(3)"Sr-Tit" indicates strontium titanate;
(4)"Ca-Ste" indicates calcium stearate.

TABLE 3

| | BS | Rising property of electrification | Abrasion of photosensitive member | Texture | Environmental stability | Fogging |
|---|---|---|---|---|---|---|
| Ex. 1 | ○ | ○ | ○ | ○ | Δ | ○ |
| Ex. 2 | ○ | ○ | ○ | ○ | ○ | ○ |
| Ex. 3 | ○ | ○ | ○ | ○ | ○ | ○ |
| Ex. 4 | ○ | ○ | ○ | ○ | ○ | ○ |
| Ex. 5 | ○ | ○ | ○ | ○ | ○ | ○ |
| Ex. 6 | ○ | ○ | ○ | ○ | ○ | ○ |
| Ex. 7 | ○ | ○ | ○ | ○ | ○ | ○ |
| Ex. 8 | ○ | ○ | ○ | ○ | ○ | ○ |
| Ex. 9 | ○ | ◎ | ○ | ○ | ○ | ○ |
| Ex. 10 | ○ | ◎ | ○ | ○ | ○ | ○ |
| Com. ex. 1 | x | ◎ | Δ | ○ | ○ | ○ |
| Com. ex. 2 | x | ◎ | Δ | ○ | ○ | ○ |
| Com. ex. 3 | x | ◎ | Δ | ○ | ○ | ○ |

TABLE 3-continued

| | BS | Rising property of electrification | Abrasion of photosensitive member | Texture | Environmental stability | Fogging |
|---|---|---|---|---|---|---|
| Com. ex. 4 | x | ◎ | Δ | ○ | ○ | ○ |
| Com. ex. 5 | Δ | ○ | x; large abrasion | ○ | ○ | ○ |
| Com. ex. 6 | ○ | ○ | x; large abrasion | ○ | ○ | ○ |
| Com. ex. 7 | ○ | ○ | x; large abrasion | ○ | ○ | ○ |
| Com. ex. 8 | ○ | x; low | ○ | x | ○ | ○ |
| Com. ex. 9 | ○ | x; low | ○ | Δ | ○ | ○ |
| Com. ex. 10 | ○ | x; low | ○ | x | ○ | ○ |
| Com. ex. 11 | ○ | x; high | x; small abrasion | ○ | ○ | Δ |
| Com. ex. 12 | ○ | Δ; high | x; small abrasion | ○ | ○ | ○ |
| Com. ex. 13 | ○ | x; high | x; small abrasion | ○ | ○ | Δ |

TABLE 4

| | BS | Rising property of electrification | Abrasion of photosensitive member | Texture | Environmental stability | Fogging |
|---|---|---|---|---|---|---|
| Ex. 11 | ○ | ○ | ○ | ○ | Δ; LL: increase | ○ |
| Ex. 12 | ○ | ○ | ○ | ○ | ○ | ○ |
| Ex. 13 | ○ | ○ | ○ | ○ | Δ; LL: increase | ○ |
| Com. ex. 14 | x | ○ | x; large abrasion | ○ | ○ | ○ |
| Com. ex. 15 | Δ | ○ | x; scratch | ○ | ○ | ○ |
| Com. ex. 16 | x | ○ | ○ | ○ | ○ | ○ |
| Ex. 14 | ○ | ○ | ○ | ○ | Δ; LL: increase | Δ |
| Ex. 15 | ○ | ○ | ○ | ○ | Δ; LL: increase | ○ |
| Ex. 16 | ○ | ○ | ○ | ○ | ○ | Δ |
| Com. ex. 17 | x | ○ | ○ | ○ | ○ | ○ |
| Com. ex. 18 | ○ | ○ | x; scratch | ○ | ○ | ○ |
| Com. ex. 19 | ○ | x; high | ○ | ○ | ○ | Δ |
| Com. ex. 20 | x | ○ | ○ | ○ | ○ | ○ |
| Com. ex. 21 | ○ | ○ | ○ | ○ | x; LL: increase | ○ |
| Com. ex. 22 | ○ | Δ | x; small abrasion | ○ | x; HH: decrease | x |
| Com. ex. 23 | ○ | ○ | x; scratch | ○ | ○ | ○ |
| Com. ex. 24 | ○ | ○ | x; large abrasion | ○ | ○ | ○ |
| Com. ex. 25 | ○ | ○ | x; large abrasion | ○ | ○ | ○ |

What is claimed is:

1. A toner which comprises (i) toner particles containing a binder resin and a colorant, (ii) a first external additive consisting of first inorganic particles whose number-average particle size is 5–40 nm, (iii) a second external additive consisting of second inorganic particles whose number-average particle size, which is larger than that of the first external additive, is 20–160 nm, (iv) a third external additive consisting of third inorganic particles whose number-average particle size, which is larger than that of the second external additive, is 80–1200 nm, and (v) a fourth external additive consisting of a metal salt of fatty acid whose volume-average particle size is 1.5–12 μm, said four external additives being externally added to the toner particles.

2. A toner of claim 1, wherein the number-average particle size of the first external additive, that of the second external additive and that of the third external additive are 10–25 nm, 30–100 nm and 80–1000 nm respectively.

3. A toner of claim 2, wherein the number-average particle size of the first external additive, that of the second external additive and that of the third external additive are 10–25 nm, 30–80 nm and 100–800 nm respectively.

4. A toner of claim 1, wherein each of the first and second inorganic particles is treated with a hydrophobicizing agent.

5. A toner of claim 1, wherein the volume-average particle size of the fourth external additive is 2–10 μm.

6. A toner of claim 1, wherein the metal salt of fatty acid is a metal salt of the fatty acid represented by the following general formula:

$C_nH_{2n+1}COOH$ (wherein n is an integer of 12–18).

7. A toner of claim 6, wherein the metal salt is calcium salt.

8. A toner of claim 6, wherein the metal salt of the fatty acid has a melting point of 100–150° C.

9. A toner which comprises (i) toner particles containing a binder resin and a colorant, (ii) a first external additive consisting of hydrophobic silica or hydrophobic titania and having number-average particle size of 5–40 nm, said first external additive being added to the toner particles in an amount of 0.05–2% by weight relative to the weight of the toner particles, (iii) a second external additive consisting of hydrophobic silica or hydrophobic titania and having number-average particle size of 20–160 nm, the number-average particle size of the second external additive being larger than that of the first external additive, said second external additive being added to the toner particles in an amount of 0.05–2% by weight relative to the weight of the toner particles, (iv) a third external additive consisting of inorganic particles having number-average particle size of 80–1200 nm, the number-average particle size of third external additive being larger than that of the second external additive, said third external additive being added to the toner particles in an amount of 0.4–3.5% by weight relative to the weight of the toner particles, and (v) the fourth external additive consisting of a metal salt of fatty acid having volume-average particle size of 1.5–12 μm, said fourth external additive being added to the toner particles in an amount of 0.02–0.25% by weight relative to the weight of the toner particles.

10. A toner of claim 9, wherein the number-average particle size of the first external additive and that of the second external additive are 10–30 nm and 30–100 nm respectively, and the adding amount of the first external additive and that of the second external additive are 0.08–1.2% by weight and 0.08–1.2% by weight respectively.

11. A toner of claim 10, wherein the number-average particle size of the third external additive is 80–1000 nm.

12. A toner of claim 9, wherein the number-average particle size of the first external additive, that of the second external additive and that of the third external additive are 10–25 nm, 30–80 nm and 100–800 nm respectively.

13. A toner of claim 9, wherein the content of the third external additive whose number-average particle size is not less than 1500 nm is not more than 20% by number of the total particle numbers of the third external additive.

14. A toner of claim 9, wherein the third external additive is at least one kind of the inorganic particles which are selected from the group consisting of silica, titania, alumina, titanate, silicate and sintered particles of these compounds.

15. A toner of claim 9, wherein the third external additive consists of strontium titanate particles.

16. A toner of claim 9, wherein the volume-average particle size of the fourth external additive is 2–10 $\mu$m.

17. A toner of claim 9, wherein the metal salt of fatty acid is a metal salt of the fatty acid represented by the following general formula:

$C_nH_{2n+1}COOH$ (wherein n is an integer of 12–18).

18. A toner of claim 17, wherein the metal salt is calcium salt.

19. A toner of claim 17, wherein the metal salt of the fatty acid has a melting point of 100–150° C.

20. A toner of claim 9, wherein the fourth external additive consists of calcium stearate particles.

* * * * *